US005695349A

United States Patent [19]

Taguchi et al.

[11] Patent Number: 5,695,349

[45] Date of Patent: Dec. 9, 1997

[54] LOCK MECHANISM OF A PAIR OF ELECTRICAL CONNECTORS

[75] Inventors: Naoto Taguchi; Kenichi Okamoto, both of Shizuoka, Japan

[73] Assignee: Yazaki Corporation, Tokyo, Japan

[21] Appl. No.: 558,180

[22] Filed: Nov. 15, 1995

[30] Foreign Application Priority Data

Nov. 22, 1994 [JP] Japan ..... 6-287923

[51] Int. Cl.[6] ..... H01R 13/62

[52] U.S. Cl. ..... 439/157

[58] Field of Search ..... 439/157, 155, 439/310, 372

[56] References Cited

U.S. PATENT DOCUMENTS

| | | | |
|---|---|---|---|
| 5,344,194 | 9/1994 | Hatagishi et al. | 439/157 |
| 5,453,018 | 9/1995 | Ito et al. | 439/157 |
| 5,474,461 | 12/1995 | Saito et al. | 439/157 |

FOREIGN PATENT DOCUMENTS 43 27 648 A1 3/1994 Germany .

*Primary Examiner*—P. Austin Bradley
*Assistant Examiner*—Tho Dac Ta
*Attorney, Agent, or Firm*—Armstrong, Westerman, Hattori, McLeLand & Naughton

[57] ABSTRACT

One of a pair of mating electrical connectors A, B has a cam groove 2 and a coupling lever C pivotally attached to the one connector. The coupling lever C has an operation portion 3 provided with a locking engagement portion 4 and a pair of lock-guiding portions 11 positioned at opposite sides of the locking engagement portion 4. The other one of the connectors has a driving pin 5 for advancing into the cam groove 2 and a lock portion 7. When the pair of connectors A, B engage with each other by operating the coupling lever C, the locking engagement portion 4 slidably engages the lock portion 7 so that the center line of the locking engagement portion 4 is urged toward the center line of the lock portion 7.

8 Claims, 4 Drawing Sheets

LOCK MECHANISM OF A PAIR OF ELECTRICAL CONNECTORS

BACKGROUND OF THE INVENTION

1. Field of the Invention

This invention relates to electrical connectors, and more particularly to a lock mechanism for a pair of mating electrical connectors having a coupling lever which requires only a low coupling and uncoupling force, for connecting wire harnesses with each other, or for connecting wire harnesses to electric equipment in automobiles.

2. Description of the Prior Art

Referring to FIG. 5, reference numeral A denotes a male connector made of synthetic resin; B denotes a female connector of the same kind; and C denotes a coupling lever pivotably engaged to a supporting shaft 1 attached to the female connector B. The coupling lever C has a cam guiding groove 2 and an operating portion 3 provided with a locking engagement portion 4 at the middle thereof. The locking engagement portion 4 includes a locking projection 4*c* having a tapered engagement guiding face 4*a* and an engagement face 4*b*.

On both side walls of the male connector A there is provided a driving pin 5 protruding from the connector and in a recess 6 of the front wall of the connector A there is provided a substantially L-shaped lock portion 7. In the recess 6, an upstanding flexible locking plate 7*a* has a lock releasing portion 7*b* at the upper end thereof extruding backwards with respect to the male connector A. The flexible locking plate 7*a* is provided with a locking hole 7*c*, and in the rear of the flexible locking plate 7*a* there is provided a stopper 7*d* for preventing an excessive deflection of the flexible locking plate 7*a*. Between the flexible locking plate 7*a* and the lock releasing portion 7*b* are provided a pair of reinforcing members 7*e*.

In the fore side of the female connector B there is provided a hood B1 for receiving the male connector A. In each inside wall of the hood B1 there is provided a pin-receiving guide grooves 8 receiving a driving pins 5. The pin-receiving guide groove 8 is aligned with, and the same in section size as, an inlet portion 2*a* of the cam groove 2 of the coupling lever C when the lever C is in the nonoperating position. In the upper wall of the hood B1 there is provided a cut-out portion 9 receiving the locking engagement portion 4. The coupling lever C keeps an upstanding position in the nonoperating state by a plate spring 10.

Accordingly, when the male connector A and the female connector B engage with each other, the driving pins 5 advance into the cam grooves 2 through the pin guide groove 8. In the state where the driving pins 5 have been received in the cam grooves 2, pivoting the coupling lever C by the operating portion 3 pulls the male connector A into the hood B1 of the female connector B. When the engagement has been completed, the locking engagement portion 4 engages with the lock portion 7 to keep the looking state. The male connector A and the female connector B have terminal-receiving slot cavities each of which face to a corresponding one in the other connector, and each terminal fitting (not shown) in the terminal-receiving slot cavities connects to a corresponding one in the engaged state of the connectors.

When the connectors completely engage with each other, a locking projection 4*c* on the locking engagement portion 4 abuts the flexible locking plate 7*a* of the lock portion 7 by way of a tapered guide surface 4*a* to enable the locking projection into the locking hole 7*c* as the flexible locking plate 7*a* is deflected backwardly. Then, a locking surface 4*b* engages with the locking hole 7*c* of the flexible locking plate 7*a* when the locking plate has returned to the upright position, as shown in FIG. 6.

In the locked condition of FIG. 6, by pushing the lock releasing portion 7*b* in the direction of an arrow head P, the flexible locking plate 7*a* is deflected backwardly so that the locking projection 4*c* is unlocked to be released from the locking hole 7*c*, as shown in FIG. 7.

In the above-mentioned structure, if the coupling lever C is pivoted by a manual force biased to one side of the operating portion 3, there may be a drawback that, due to the lateral inclination of the operating portion 3, the center line L1 of the locking engagement portion 4 will deviate from the center line L2 of the lock portion 7, as shown in FIG. 8, so that the locking projection 4*c* does not engage with the locking hole 7*c*.

SUMMARY OF THE INVENTION

This invention is provided to eliminate the above-mentioned drawback. Therefore, even if there is a lateral inclination of the operating portion in the operation of the coupling lever, the center line of the locking engagement portion related to the coupling lever is forced to be in line with the center line of the lock portion related to the connector to enable a secure engagement.

For achieving the above-mentioned object, a first aspect of the invention includes one of a pair of electrical connectors engaging with each other having a cam groove and an coupling lever pivotably attached to the one connector, wherein the coupling-operating lever has an operation portion provided with a locking engagement portion and a pair of lock-guiding portions, each of which is positioned at the respective sides of the locking engagement portion; and the other one of the connectors having a driving pin for advancing into the cam groove, and a lock portion.

When the pair of connectors engage with each other by operating the coupling lever, the locking engagement portion slidably abuts the lock guiding portions so that the center line of the locking engagement portion can move toward the center line of the lock portion.

Further, a second aspect of the invention includes one connector B' of a pair of electrical connectors, which engage with each other, having a cam groove 2 and a coupling lever C' pivotably attached to the one connector B', wherein the coupling operating lever C' has an operation portion 3 provided with a locking engagement portion 4 and a pair of lock guiding portions 11, 11 positioned at both sides of the locking engagement portion 4; and the other one of the connectors has a driving pin 5 advancing into the cam groove 2, a lock portion 7, and lock protecting walls 7', 7' positioned at the respective sides of the lock portion 7.

When the pair of connectors engage with each other by operating the engagement lever C', the lock-guiding portion 11 slidably abuts the lock-protecting wall 7' so that the center line of the locking engagement portion 4 can move toward the center line of the lock portion 7.

Further, a third aspect of the invention includes one of a pair of electrical connectors A, B engaging with each other having a cam groove 2, a lock portion 7, and a coupling lever C pivotably attached to the one of connectors, wherein the coupling lever C has an operation portion 3 provided with a locking engagement portion 4 and a pair of lock guiding portions 11, 11 positioned one at each side of the locking engagement portion 4; and the other one of the connectors having pin 5 for advancing into the cam groove 2.

When the pair of connectors A, B engage with each other by operating the coupling lever C, the lock-guiding portion 11 slidably abuts to the lock portion 7 so that the center line of the locking engagement portion 4 can move toward the center line of the lock portion 7.

Further, a fourth aspect of the invention includes one connector B' of a pair of electrical connectors engaging with each other having a cam groove 2, a lock portion 7, lock protecting walls 7', 7' positioned one at each side of the lock portion 7, and a coupling lever C' pivotably attached to the one connector B', wherein the coupling lever C' has an operation portion 3 provided with a locking engagement portion 4 and a pair of lock-guiding portions 11, 11 positioned at both sides of the locking engagement portion 4; and the other one of the connectors has a driving pin 5 for advancing into the cam groove 2.

When the pair of connectors engage with each other by operating the coupling lever C', the locking-guiding portion 11 slidably abuts the lock protecting portion 7' so that the center line of the locking engagement portion 4 can move toward the center line of the lock portion 7.

Accordingly, in the operations of the above-mentioned aspects of invention, the lock-guiding portion slidably abuts the lock portion or the lock protecting portion so as to correct the position of the coupling lever so that the center line of the locking engagement portion can move toward the center line of the lock portion.

As a result, this invention has an advantage that the locking engagement portion of the coupling lever securely engages with the lock portion of the connector.

DETAILED DESCRIPTION OF PREFERRED EMBODIMENTS

Figure 1:
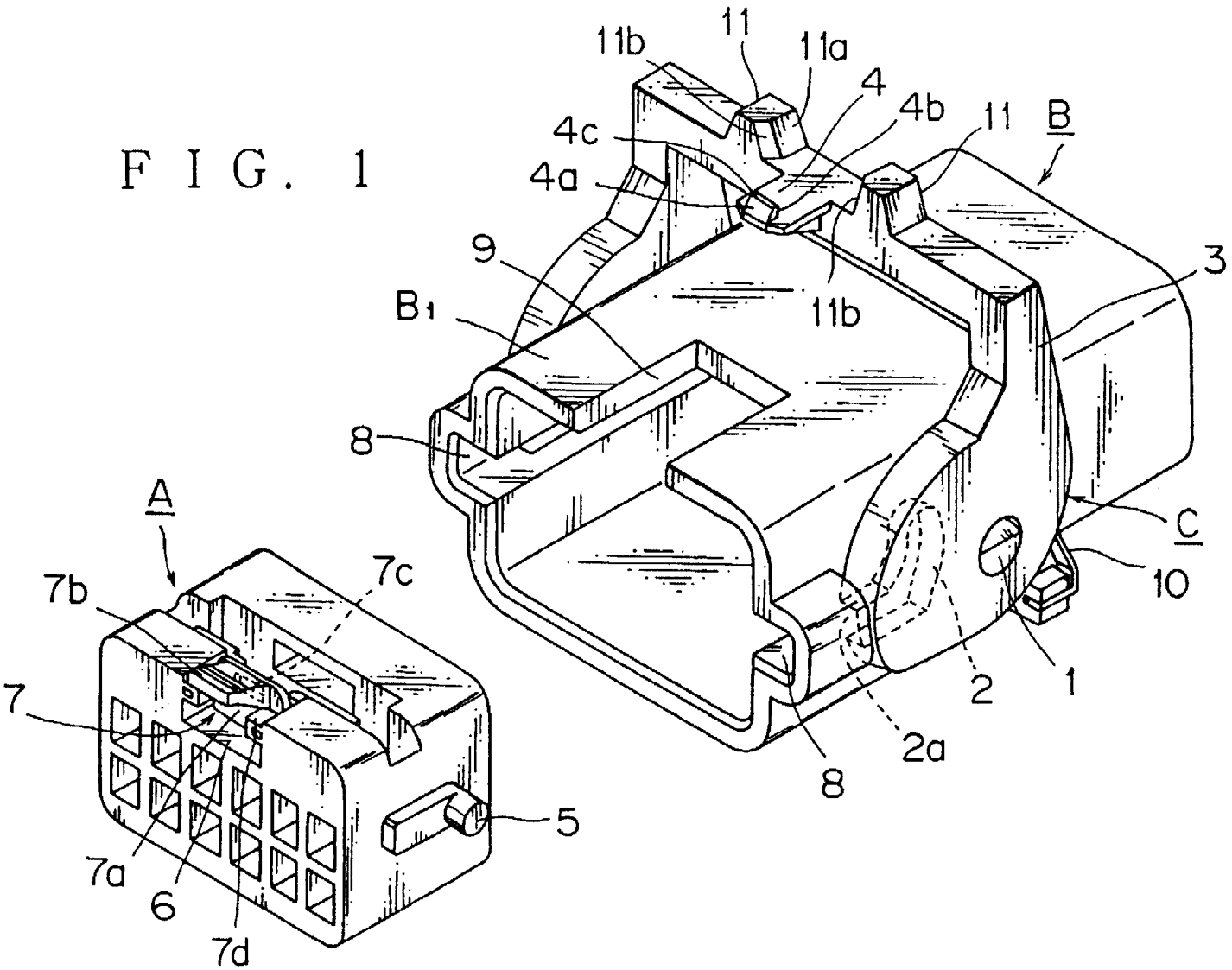
FIG. 1 is a perspective view showing a pair of mating electrical connectors according to an embodiment of the present invention in their separated state.
Figure 5:
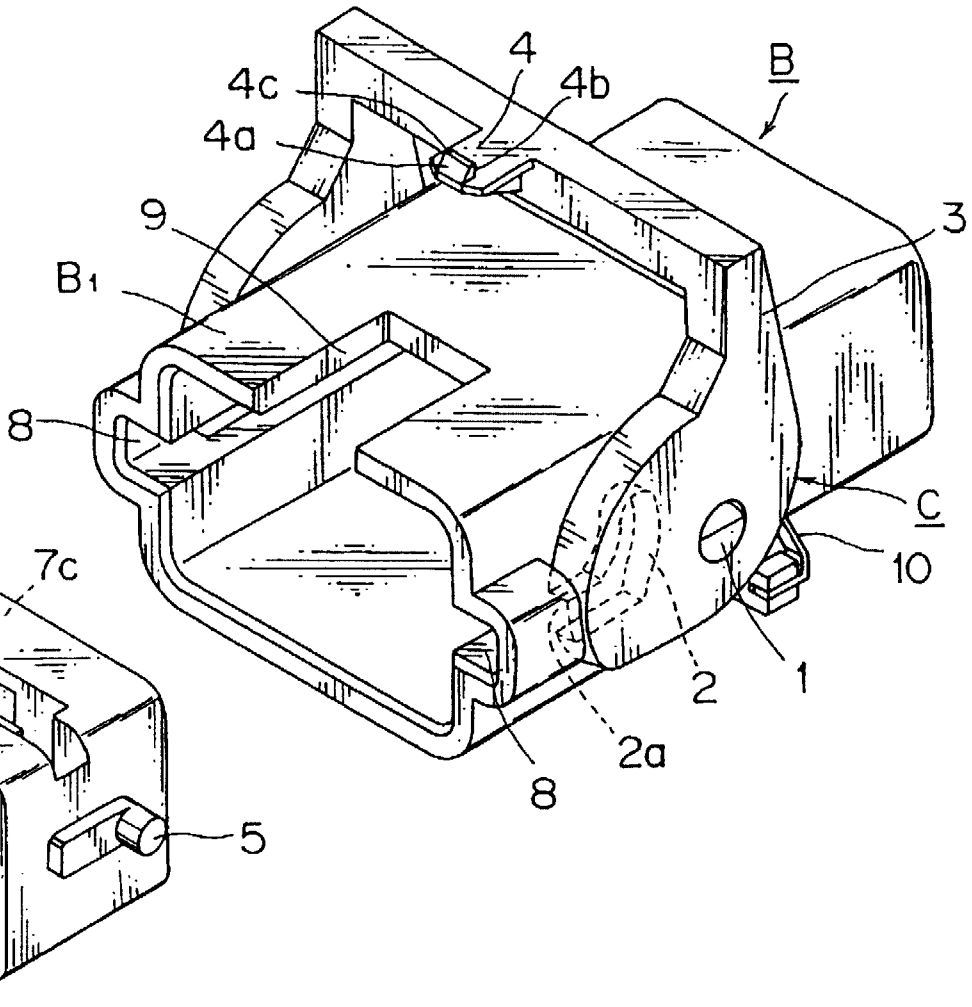
FIG. 5 PRIOR ART
FIG. 5 is a perspective view showing a pair of mating electrical connectors of the prior art in their separated state.
Figure 8:
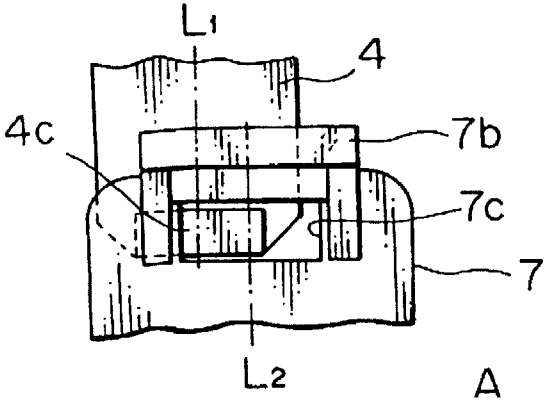
FIG. 8 PRIOR ART
FIG. 8 is a front view showing primary parts of the prior art in FIG. 5 in the incomplete lock engagement state.

FIG. 1 is an embodiment of this invention, which includes a male connector A, a female connector B, and a coupling lever C similar to the prior art shown in FIG. 5. The same reference symbols are accordingly given to the same portions as ones of the prior art.

Specifically in this invention, an operating portion 3 of the coupling lever C is provided with lock-guiding projecting portions 11, 11 in both sides of a locking engagement portion 4. In the sides of the pair of lock-guiding projecting portions 11, 11, facing the locking engagement portion there are provided tapered lock-guiding faces 11*a*, 11*a*.

Further, the tapered lock-guiding faces 11*a*, 11*a* are provided each with a tapered abutting face 11*b*, 11*b* at the leading edges thereof in the pivoting direction of the coupling lever C when the connectors are coupled.

Figure 2A:
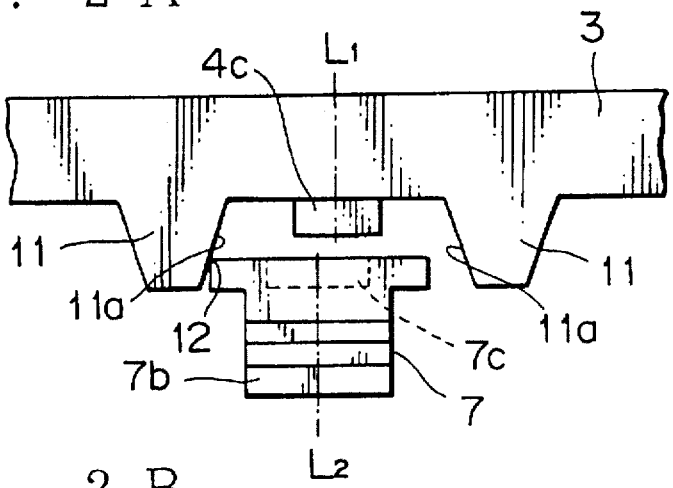
FIG. 2A and FIG. 2B are enlarged views showing a movement of a lock guiding portions in the locking operation of the embodiment.
Figure 2B:
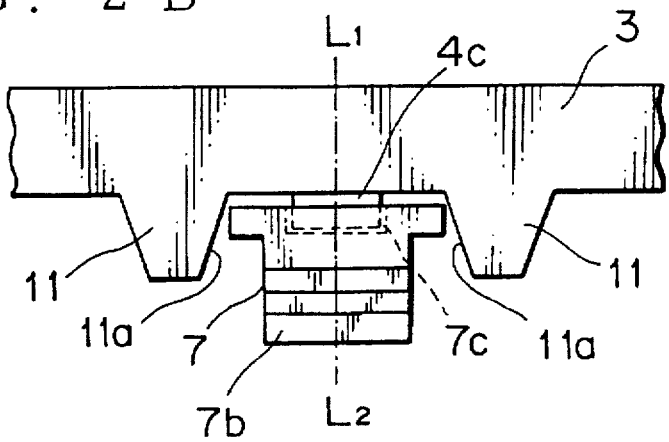
Figure 6:
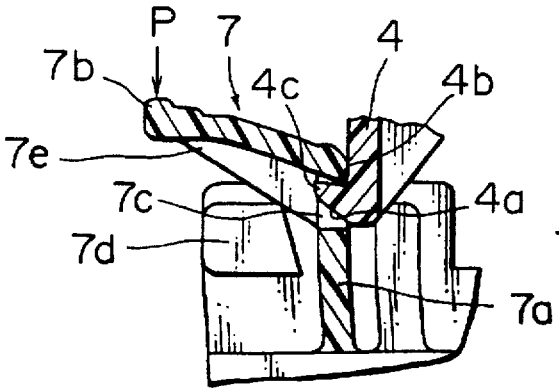
FIG. 6 PRIOR ART
FIG. 6 is a sectional view showing primary parts of the prior art in FIG. 5 in the lock engagement state.
Figure 7:
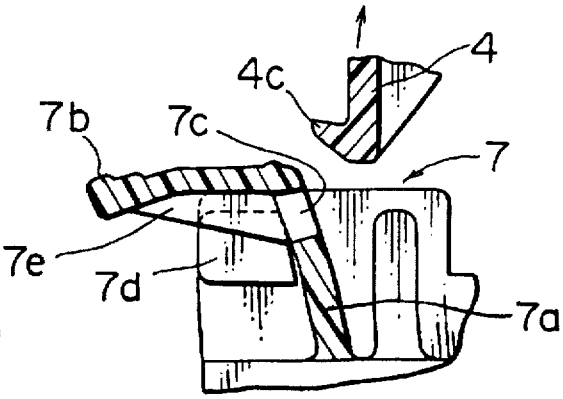
FIG. 7 PRIOR ART
FIG. 7 is a sectional view showing primary parts of the prior art in FIG. 5 in the lock released state.

In the above-mentioned structure, when pivoting the coupling lever C forward to the female connector B in the coupling operation of the connectors A, B by a manual force biased to one side of the operating portion 3, the center line L1 of the locking engagement portion 4 may initially deviate from the center line L2 of the lock portion 7, as shown in FIG. 2A. However, one of the lock-guiding projecting portions 11 abuts a leading corner 12 of the lock portion 7 at a tapered lock guiding face 11*a*, which corrects the transverse position of the operating portion 3 toward the position that the center lines L1, L2 are in line with each other so that the locking projection 4*c* surely engages with the locking hole 7*c*, as shown in FIG. 2B.

Figure 3:
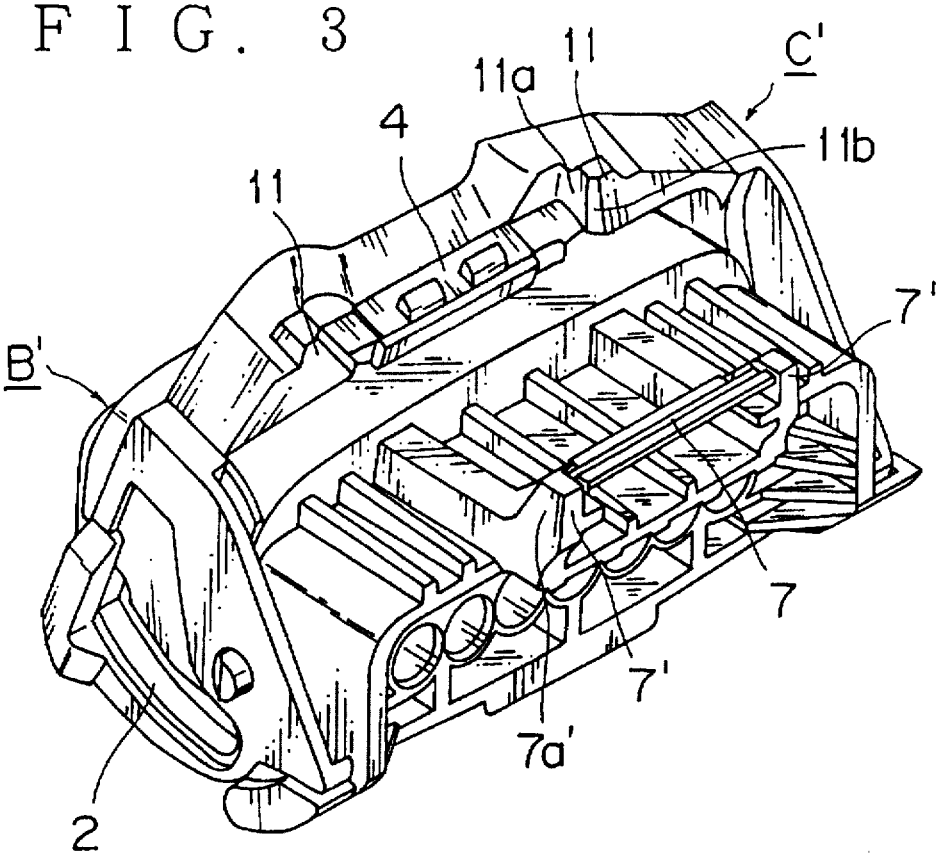
FIG. 3 is a perspective view showing a female connector according to another embodiment of the present invention before engagement operation thereof.

In another embodiment, shown in FIG. 3, a female connector B' has a flexible lock portion 7 provided above a top wall of the female connector housing. On both sides of the flexible lock portion 7 there are provided upstanding, lock-protecting walls 7', 7' that each have an engagement guiding surface 7*a'* tapered from the bottom to the top of the wall 7', while a coupling lever C', pivotably attached to the connector B', has a locking engagement portion 4 and protruding, lock guiding portions 11 at both sides of the locking engagement portion 4. Further, the pair of lock-guiding portions 11, 11 are provided with tapered lock guiding faces 11*a*, 11*a* opposing each other. Moreover, at each leading end of the tapered lock guiding faces 11*a*, 11*a* there is provided a tapered abutting face 11*b* for guiding the engagement of the lever C.

A male connector, not illustrated, has a driving pin for advancing into a cam groove 2 formed in the coupling lever C' so that pivoting the coupling lever C' to the rear of the female connector B' causes the pair of male and female to engage with each other.

In the above-mentioned structure, when the coupling lever C' pivots toward the rear of the female connector B' so that the pair of connectors engage with each other, the locking engagement portion 4 and the lock portion 7 may possibly approach each other with their centers being mutually offset. Even in that case, one of the tapered lock-guiding faces 11*a* of the lock guiding portion 11 slidably engages to the tapered engagement guiding surface 7*a'* of the facing lock protecting walls 7' to correct the offset so that the locking engagement portion 4 can engage with the lock portion 7(FIG. 4).

Figure 4:
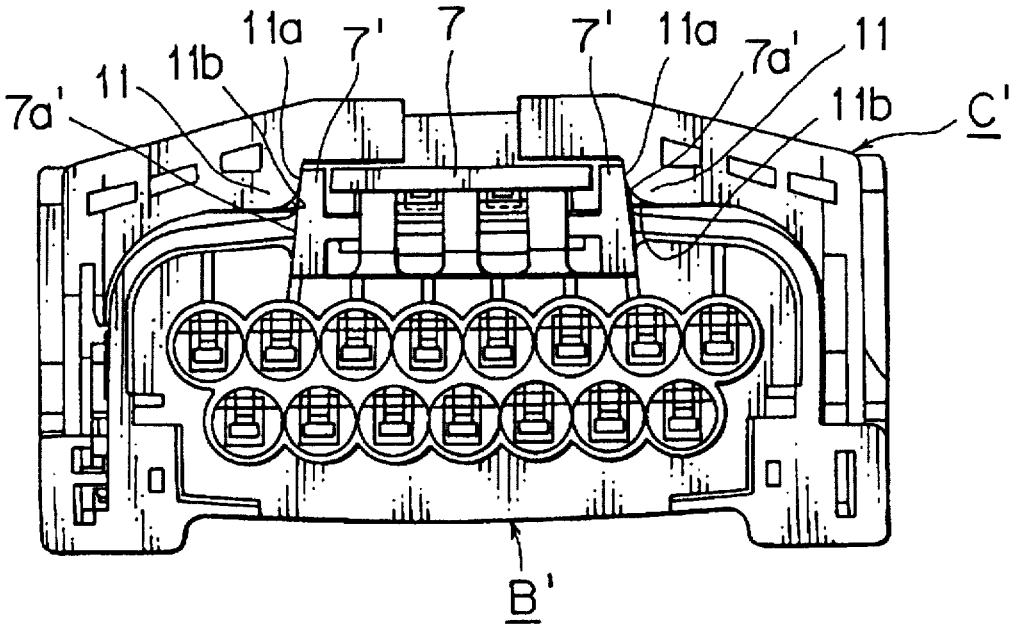
FIG. 4 is a front view showing primary parts of the embodiment in FIG. 3 in the lock engagement state.

In the embodiment of FIGS. 3 and 4, the lock portion 7 and the lock-protecting walls 7', 7' may be provided on the male connector and the coupling lever C' having a structure that enables it to pivot toward the front part of the male connector in the coupling operation.

In the embodiment in FIGS. 1 and 2, the lock portion 7 may be provided in the rear of the female connector B and the coupling lever C having a structure that enables it to pivot toward the rear of the female connector B.

What is claimed is:

1. An electrical connector apparatus including a pair of cooperating connectors comprising:

one of said connectors having a cam groove and a coupling lever pivotally attached thereto, said coupling lever having an operation portion provided with a locking engagement portion extending therefrom, the other of said connectors having a driving pin advanceable into said cam groove upon pivoting of said coupling lever, and a lock portion to lockingly engage said locking engagement portion when said connectors are completely interconnected by the operation of said coupling lever, and a lock-guiding portion disposed on said one connector adjacent and laterally spaced from said locking engagement portion, said lock-guiding portion having a surface thereon positioned with respect to said locking engagement portion to slidingly engage said lock portion prior to engagement of said locking engagement portion therewith to thereby align said locking engagement portion with said lock portion prior to commencement of interconnection of said connectors by pivoting of said coupling lever.

2. An electrical connector apparatus including a pair of cooperating connectors comprising:

one of said connectors having a cam groove and a coupling lever pivotally attached thereto, said coupling lever having an operation portion provided with a locking engagement portion, the other of said connectors having a driving pin advanceable into said cam groove upon pivoting of said coupling lever, a lock portion to lockingly engage said locking engagement portion when said connectors are completely interconnected by operation of said coupling lever, and lock protecting surfaces disposed on opposite sides of said lock portion, and a pair of mutually spaced, oppositely facing lock-guiding portions disposed on opposite sides of, and extending laterally of, said locking engagement portion, said lock-guiding portions each having a surface positioned with respect to said locking engagement portion to slidingly engage said lock-protecting surfaces prior to engagement of said locking engagement portion with said lock portion and thereby align said locking engagement portion with said lock portion prior to commencement of interconnection of said connectors by pivoting of said coupling lever.

3. An electrical connector apparatus including a pair of cooperating connectors comprising:

one of said connectors having a cam groove, a lock portion and a coupling lever pivotally attached thereto, said coupling lever having an operation portion provided with a locking engagement portion engageable with said lock portion and a pair of mutually spaced, oppositely facing lock-guiding portions positioned at respective sides of said locking engagement portion, the other of said connectors having a driving pin advanceable into said coupling lever upon pivoting of said coupling lever, said lock-guiding portions having surfaces thereon adapted to slidingly engage said lock portion and thereby align said locking engagement portion with said lock portion prior to commencement of interconnection of said connectors by pivoting of said coupling lever.

4. An electrical connector apparatus including a pair of cooperating connectors comprising:

one of said connectors having a cam groove, a lock portion, lock protecting walls disposed on opposite sides of said lock portion and a coupling lever pivotally attached thereto, said coupling lever having an operation portion provided with a locking engagement portion engageable with said lock portion and a pair of mutually spaced, oppositely facing lock-guiding portions positioned at respective sides of said locking engagement portion, the other of said connectors having a driving pin advanceable into said coupling lever upon pivoting of said coupling lever, said lock-guiding portions having surfaces thereon adapted to slidingly engage said lock-protecting walls and thereby align said locking engagement portion with said lock portion prior to commencement of interconnection of said connectors by pivoting of said coupling lever.

5. An electrical connector apparatus as claimed in any one of claims 2 to 4, wherein said pair of lock guiding portions are each provided with a tapered lock-guiding surface in opposition each to the other.

6. An electrical connector apparatus as claimed in claim 5, wherein said each tapered surface of said lock-guiding portion is provided with a tapered abutting portion adjacent the leading end of said lock-guiding portion in the direction of pivoting rotation of said coupling lever when said connectors are being coupled.

7. An electrical connector apparatus as claimed in claim 4, wherein said pair of lock-protecting walls are each provided with a tapered lock-guiding surface at an outside face of said lock-protecting wall.

8. An electrical connector apparatus as claimed in claim 2, wherein said pair of lock-guiding portions are each provided with a tapered abutting face at an outside surface of said lock-guiding portion.

* * * * *